US007578566B2

(12) United States Patent
DiEnno et al.

(10) Patent No.: US 7,578,566 B2
(45) Date of Patent: Aug. 25, 2009

(54) RIBBED ESCUTCHEON FOR APPLIANCE DOOR ASSEMBLY

(75) Inventors: John Joseph DiEnno, Louisville, KY (US); Roger Shawn Nelson, Louisville, KY (US); Jeffrey Thomas Kiesler, Louisville, KY (US); Deryl Craig York, Tempe, AZ (US); Raymond Edward Yuenger, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/682,422

(22) Filed: Aug. 31, 2001

(65) Prior Publication Data

US 2003/0205952 A1 Nov. 6, 2003

(51) Int. Cl.
*A47B 97/00* (2006.01)

(52) U.S. Cl. ..... 312/204; 312/265.6

(58) Field of Classification Search ..... 312/228, 312/257.1, 204, 265.5, 265.6, 263, 293.3, 312/228.1; 49/501; 220/376; 40/611.06, 40/611.1; 248/27.1; 52/204.597, 208; 126/190
See application file for complete search history.

(56) References Cited

U.S. PATENT DOCUMENTS

| | | | | | |
|---|---|---|---|---|---|
| 3,294,461 | A | * | 12/1966 | Barnard et al. | 312/213 |
| 3,767,281 | A | * | 10/1973 | Adams | 312/265.1 |
| 3,773,399 | A | * | 11/1973 | Sulcek | 312/204 |
| 3,876,469 | A | * | 4/1975 | Schimke | 134/95.2 |
| 3,936,107 | A | | 2/1976 | Gourdeau et al. | |
| 4,179,821 | A | * | 12/1979 | Herbst et al. | 34/235 |
| 4,478,465 | A | * | 10/1984 | Sulcek | 312/183 |
| 4,732,431 | A | | 3/1988 | Mason | |
| 4,765,697 | A | * | 8/1988 | Gardell et al. | 312/229 |
| 5,366,185 | A | * | 11/1994 | Michael et al. | 248/27.1 |
| 5,453,586 | A | | 9/1995 | Stottmann | |
| 5,466,062 | A | * | 11/1995 | McPherson et al. | 312/348.6 |
| 5,571,276 | A | | 11/1996 | Kobos et al. | |
| 5,625,969 | A | * | 5/1997 | Vogler | 40/611.12 |
| 5,848,735 | A | * | 12/1998 | Eddy et al. | 312/265.5 |
| 6,065,820 | A | * | 5/2000 | Fleissner et al. | 312/265.5 |

* cited by examiner

*Primary Examiner*—James O Hansen
(74) *Attorney, Agent, or Firm*—George L. Rideout, Esq.; Armstrong Teasdale LLP

(57) ABSTRACT

An escutcheon for an appliance door assembly is provided. The escutcheon includes a control panel mounting surface comprising a lower edge, and a plurality of formations depending from said lower edge and defining a retaining slot.

6 Claims, 5 Drawing Sheets

RIBBED ESCUTCHEON FOR APPLIANCE DOOR ASSEMBLY

BACKGROUND OF INVENTION

This invention relates generally to door assemblies for appliances, and, more particularly, to door assemblies for dishwasher systems including a top-mounted escutcheon.

Known dishwasher door assemblies typically include an escutcheon therein for providing support for control panel components. Typically, the escutcheon is separately molded from a plastic material and is attached to an upper portion of the door assembly above an outer door panel and generally flush with an outer surface of the door panel. Control buttons, knobs, displays etc. extend through the escutcheon for user manipulation to select and execute desired dishwasher features. See, for example, U.S. Pat. No. 5,453,586.

Escutcheons, however, can be difficult to mate with outer panels of the door. Variance of the outer panels in production frustrates a consistent flush appearance between the outer door panel and the escutcheon, and typically requires manual and time consuming attachment of the escutcheon to the top of the outer door panel. These problems are especially appreciated when an outer panel of the door is not flat, such as consumer desirable outwardly bowed or curved outer door panels are employed. Due to variances in the curvature of the panels, proper attachment of the escutcheon to outer door panels can be difficult, thereby increasing assembly time and assembly costs of the door.

SUMMARY OF INVENTION

In one aspect, an escutcheon for an appliance door assembly is provided. The escutcheon comprises a control panel mounting surface comprising a lower edge, and a plurality of formations depending from said lower edge and defining a retaining slot.

In another aspect, an escutcheon for a dishwasher door assembly is provided that comprises a lower edge and a plurality of formations depending therefrom, each formation comprising an angled guide surface, said guide surface defining a retaining slot.

In still another aspect, an appliance door assembly is provided. The door assembly comprises an outer door panel comprising an edge and an outer surface and an escutcheon attached to said edge. The escutcheon comprises a plurality of formations defining a retaining slot, said formations locating said outer surface within said slot when said edge is received in said slot.

In yet another aspect, a dishwasher door assembly is provided. The door assembly comprises an outer door panel comprising an edge and a curved outer surface and an escutcheon attached to said edge. The escutcheon comprises a plurality of formations defining a retaining slot, each said formation comprising a panel engagement portion, said panel engagement portion positioning said edge within said slot to that said panel outer surface is substantially flush with an outer surface of said escutcheon.

DETAILED DESCRIPTION

Figure 1:
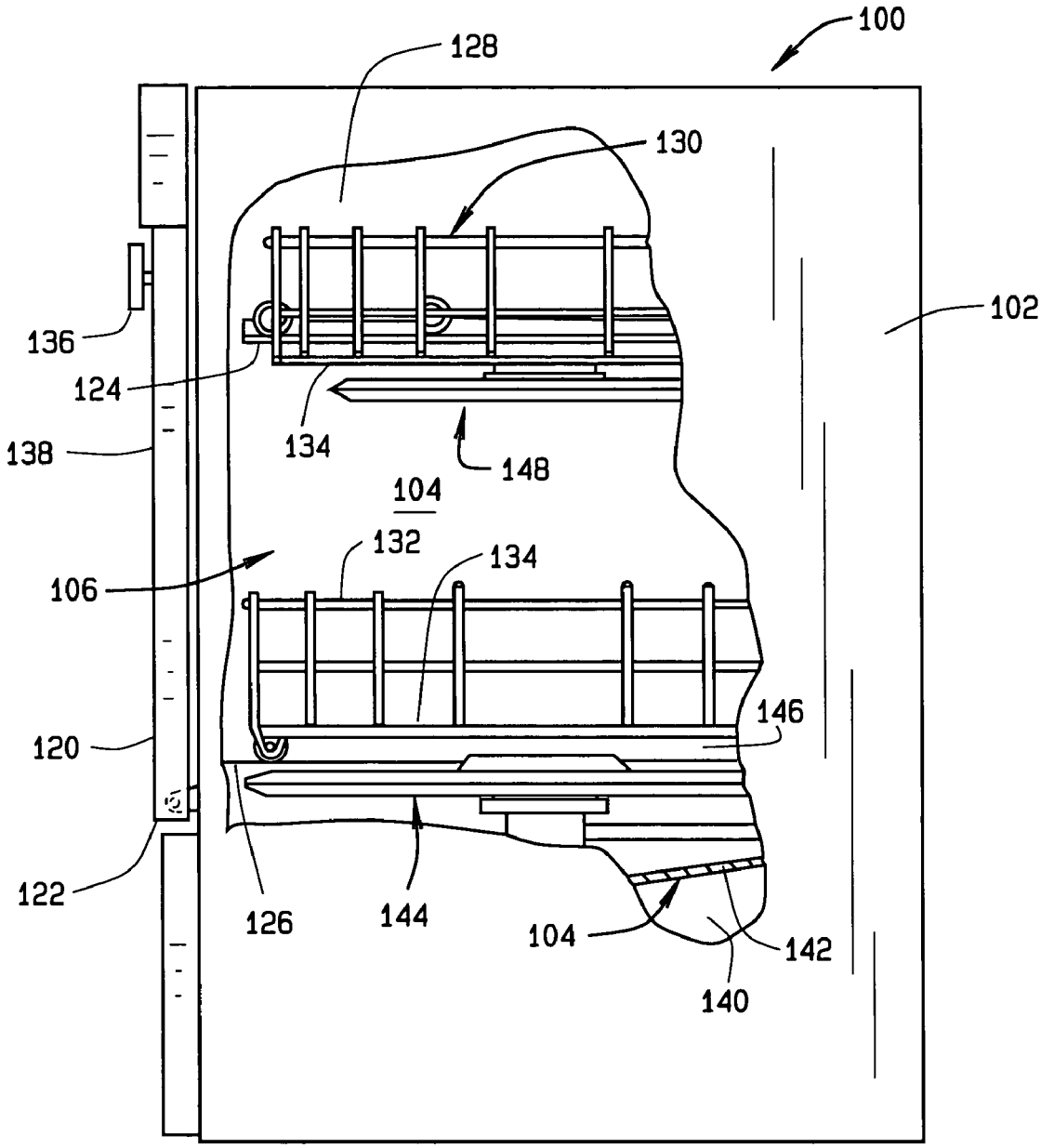
FIG. 1 is a side elevational view of an exemplary dishwasher system partially broken away.

FIG. 1 is a side elevational view of an exemplary domestic dishwasher system 100 partially broken away, and in which the present invention may be practiced. It is contemplated, however, that the invention may be practiced in other types of dishwashers and dishwasher systems beyond dishwasher system 100 described and illustrated herein. Moreover, the door construction described below may find utility and its benefits accrue to appliances generally Accordingly, the following description is for illustrative purposes only, and the invention is in no way limited to use in a particular type of appliance, such as a particular dishwasher system, for example dishwasher system 100.

Dishwasher 100 includes a cabinet 102 having a tub 104 therein and forming a wash chamber 106. Tub 104 includes a front opening (not shown in FIG. 1) and a door assembly 120 hinged at its bottom 122 for movement between a normally closed vertical position (shown in FIG. 1) wherein wash chamber 106 is sealed shut for washing operation, and a horizontal open position (not shown) for loading and unloading of dishwasher contents. Upper and lower guide rails 124, 126 are mounted on tub side walls 128 and accommodate upper and lower roller-equipped racks 130, 132, respectively. Each of upper and lower racks 130, 132 is fabricated from known materials into lattice structures including a plurality of elongate members 134, and each rack 130, 132 is adapted for movement between an extended loading position (not shown) in which the rack is substantially positioned outside wash chamber 106, and a retracted position (shown in FIG. 1) in which the rack is located inside wash chamber 106. Conventionally, a silverware basket (not shown) is removably attached to lower rack 132 for placement of silverware, utensils, and the like that are too small to be accommodated by upper and lower racks 130, 132.

A control panel (not shown in FIG. 1) is integrated into an escutcheon 136 that is mounted to door assembly 120. A control panel is mounted to escutcheon 136 at a convenient location relative to an outer face 138 of door assembly 120 and includes control selectors, (e.g., buttons, switches or knobs), and applicable control displays. The control panel and associated selectors and displays are coupled to known control circuitry (not shown) and control mechanisms (not shown) for operating a fluid circulation assembly (not shown) that circulates water and dishwasher fluid in dishwasher tub 104. The fluid circulation assembly is located in a machinery compartment 140 located below a bottom sump portion 142 of tub 104. The construction and operation of the fluid circulation assembly is believed to be beyond the scope of the present invention but well within the purview of those in the art without detailed explanation, and further discussion of the fluid circulation assembly is therefore omitted.

A lower spray-arm-assembly 144 is rotatably mounted within a lower region 146 of wash chamber 106 and above tub sump portion 142 so as to rotate in relatively close proximity to lower rack 132. A mid-level spray-arm assembly 148 is located in an upper region of wash chamber 106 and is located in close proximity to upper rack 130 and at a sufficient height above lower rack 132 to accommodate a largest item, such as a dish or platter (not shown), that is expected to be placed in lower rack 132 and washed in dishwasher system 100. In a further embodiment, an upper spray arm assembly (not shown) is located above upper rack 130 at a sufficient height to accommodate a tallest item expected to be placed in upper rack 130, such as a glass (not shown) of a selected height.

Lower and mid-level spray-arm assemblies 144, 148 and the upper spray arm assembly are fed by the fluid circulation assembly, and each spray-arm assembly includes an arrangement of discharge ports or orifices for directing washing liquid onto dishes located in upper and lower racks 130, 132, respectively. The arrangement of the discharge ports in at least lower spray-arm assembly 144 provides a rotational force by virtue of washing fluid flowing through the discharge ports. The resultant rotation of lower spray-arm assembly 144 provides coverage of dishes and other dishwasher contents with a washing spray. In various alternative embodiments, mid-level spray arm 148 and/or the upper spray arm are also rotatably mounted and configured to generate a swirling spray pattern above and below upper rack 130 when the fluid circulation assembly is activated and door assembly 120 is properly closed to seal wash chamber 106 for operation.

Figure 2:
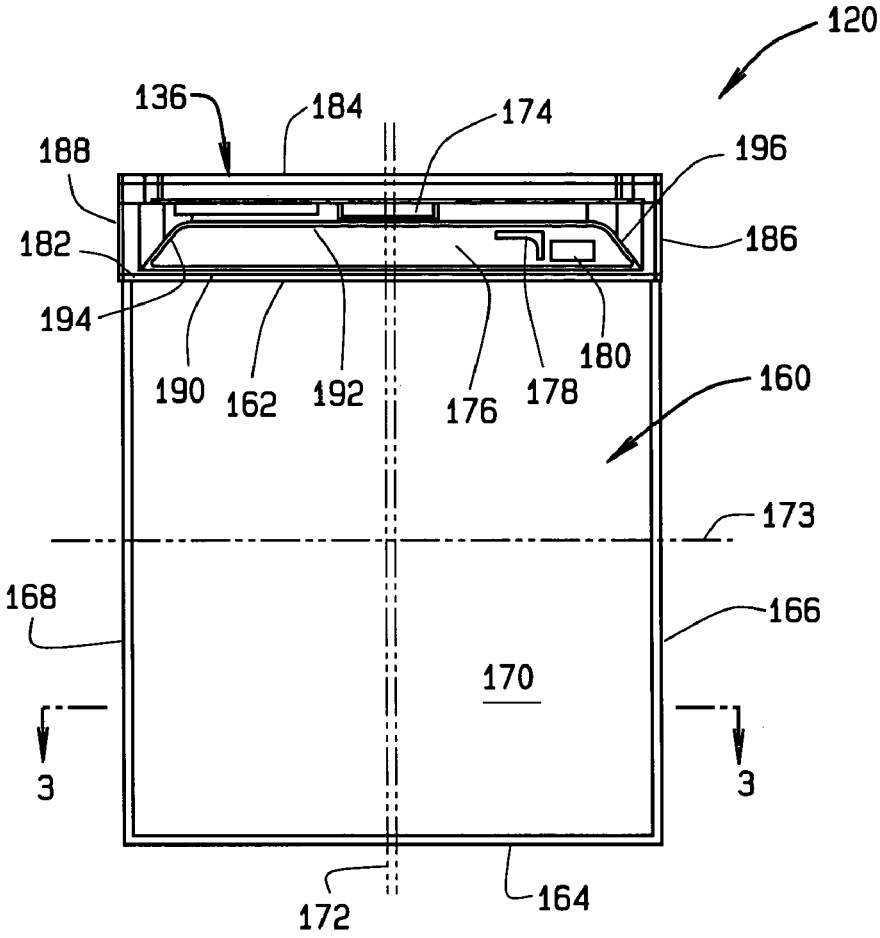
FIG. 2 is a front elevational view of the dishwasher door assembly shown in FIG. 1.

FIG. 2 is a front elevational view of dishwasher door assembly 120 (shown in FIG. 1) including an outer door panel 160, an inner door panel (not shown) and escutcheon 136 mounted to an upper edge thereof. Outer door panel 160 and the inner door panel together form a sturdy door frame for door assembly 120 (shown in FIG. 1), and escutcheon 136 is firmly attached thereto above an upper edge 162 of outer door panel 160. In accordance with conventional dishwasher systems, the inner door panel includes a contoured surface (not shown) for accommodating, for example, lower dishwasher rack 132 (shown in FIG. 1), a detergent dispenser (not shown), and vent assemblies (not shown). In addition, and also in accordance with known dishwashers, a dishwasher control module (not shown) is located between outer door panel 160 and the inner door panel, together with a latch mechanism (not shown) for proper closing of dishwasher door assembly 120 in use.

Outer door panel 160 is substantially rectangular in shape and includes a lower edge 164 extending approximately parallel to outer door panel upper edge 162, and lateral side edges 166, 168 extending substantially perpendicular to upper and lower side edges 162, 162. An outer surface 170 of outer door panel 160 extends between upper and lower edges 162, 164, and also between panel lateral sides 166, 168. In one embodiment, outer surface 170 is slightly outwardly curved, or bowed, between outer door panel lateral side edges 166, 168 relative to a longitudinal axis 172 of outer door panel 160, while extending generally linearly between upper and lower edges 162, 164, respectively. In other words, upper edge 162 and lower edge 164 of outer door panel 160 are substantially equally curved about panel longitudinal axis 172 and extend substantially parallel to one another. Lateral side edges 166, 168 are substantially straight and parallel such that there is generally no curvature of outer door panel 160 about a lateral axis 173 of outer door panel 160.

Outer door panel 160, in one embodiment, is fabricated from metal according to known methods and techniques, including but not limited to deep drawing and stamping processes. In alternative embodiments, it is contemplated that other materials and other fabrication methods may be employed without departing from the scope of the present invention. Panel outer surface 170 is painted and/or surface treated to provide an appropriate decor for dishwasher 100 (shown in FIG. 1).

Escutcheon 136 is mounted to upper edge 162 of outer door panel 160 and, in one embodiment, is fabricated from an injection molded plastic material. It is contemplated, however, that other suitable materials and fabrication methods may be employed within the scope of the present invention. Escutcheon 136 includes a latch portion 174 for engagement with a door latch assembly (not shown), such as a dishwasher latch assembly known in the art, and also includes a control panel mounting surface 176 extending beneath escutcheon latch portion 174. Control panel mounting surface 176, in an exemplary embodiment, is substantially flat and planar and includes appropriate openings 178 therethrough for routing wire leads of a control panel (not shown), and also openings 180 therethrough for control displays, selectors, and control components. In one embodiment, escutcheon 136 is configured for surface mounting of a membrane switch assembly control panel (not shown) familiar to those in the art, and the membrane switch assembly may be attached to control panel mounting surface 176 with suitable adhesive materials, such as pressure sensitive tape. In alternative embodiments, other mechanical, electrical or electromechanical control panel mechanisms known in the art may be mounted, connected, coupled, attached, or otherwise engaged to escutcheon 136 and coupled to a dishwasher control module or mechanism (not shown), such as for example, a control board (not shown) for executing user selected dishwasher cycles and features.

In one embodiment, escutcheon 136 is substantially rectangularly shaped and includes a lower edge 182 mated to outer panel upper edge 162, an upper edge 184 extending substantially parallel to escutcheon lower edge 182, and substantially parallel lateral side edges 186, 188 extending between respective ends of escutcheon lower edge 182 and escutcheon upper edge 184. Control panel mounting surface 176 extends between upper and lower edge 182, 184 and in one embodiment, is inclined with respect to longitudinal axis 172 of door assembly 120.

More specifically, control panel mounting surface 176 includes a substantially straight lower edge 190 extending between escutcheon lateral edges 186, 188, an upper edge 192 extending substantially parallel to control panel mounting surface lower edge 190 but inwardly displaced from lower edge 190, and angled lateral edges 194, 196 connecting respective edges of lower edge 190 and upper edge 192 of control mounting surface 176. Control mounting surface lower edge 190 extends generally parallel to and flush with escutcheon lower edge 182, while control panel mounting surface upper edge 192 is inwardly displaced from lower edge 190 and escutcheon upper edge 184. Thus, control panel mounting surface 176 is recessed relative to escutcheon upper edge 184 and therefore at least somewhat protected from countertop spills and drips onto escutcheon upper edge 184.

Figure 3:
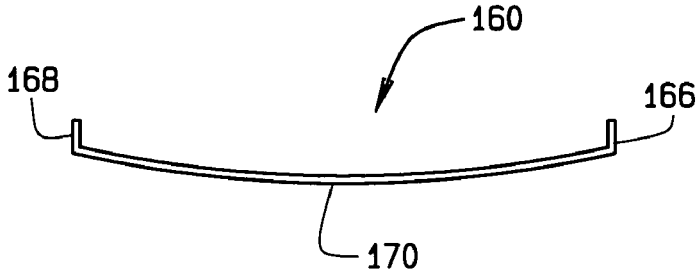
FIG. 3 is a cross sectional view of the outer door panel shown in FIG. 2 along line 3-3.

FIG. 3 is a cross sectional view of outer door panel 160 illustrating outwardly curved (concave in FIG. 3) or bowed outer surface 170 extending between lateral side edges 166, 168. It is contemplated, however, that the benefits of the present invention may be appreciated with substantially planar outer door panels, i.e., panels generally without curvature.

Figure 4:
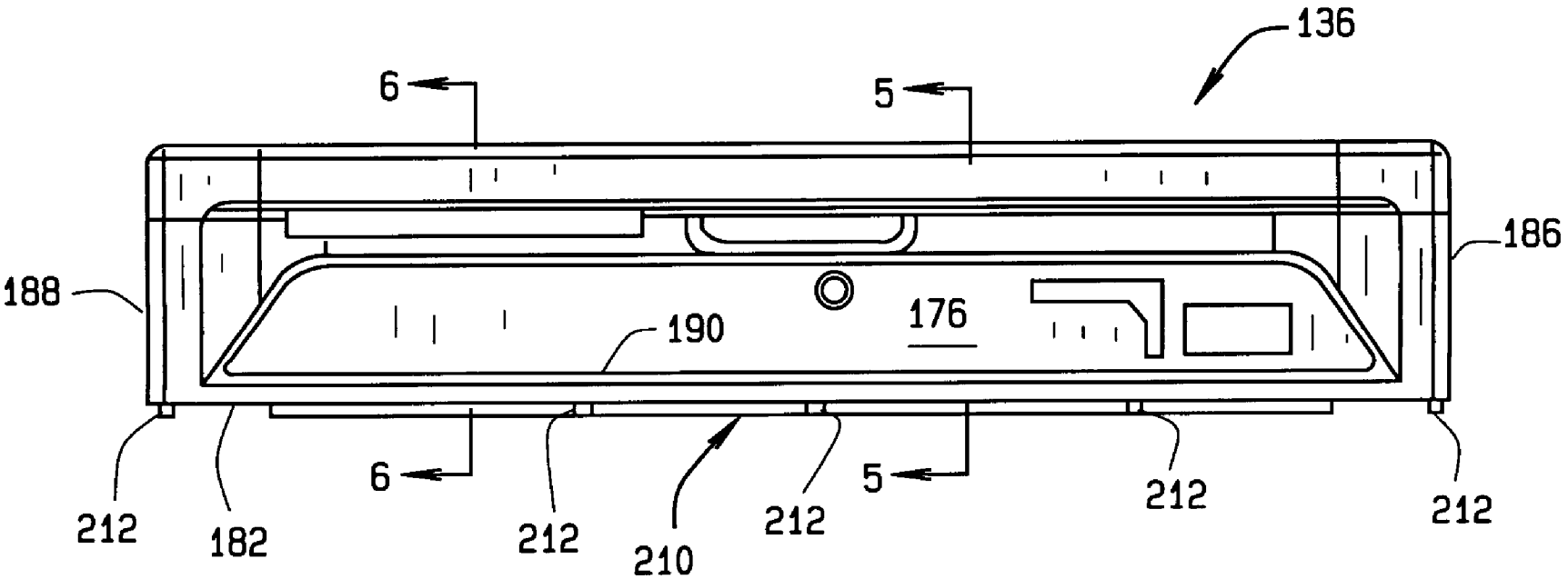
FIG. 4 is a front elevational view of the escutcheon for the dishwasher door assembly shown in FIG. 2.

FIG. 4 is a front elevational view of escutcheon 136 illustrating a number of formations 210 depending from escutcheon lower edge 182. Formations 210 facilitate proper positioning of escutcheon 136 relative to outer door panel upper edge 162 (shown in FIG. 2), as further described below. In one embodiment, formations 210 include an elongated retaining slot (not shown in FIG. 4) for receiving outer door panel upper edge 162, and a plurality of positioning ribs 212 extending into the slot to engage panel upper edge 162 and properly position outer panel 160 (shown in FIG. 2) relative to the slot. As such, a uniform flush appearance between escutcheon lower edge 182 and outer panel upper edge 162 is consistently obtained while simplifying assembly of the door. In one embodiment, escutcheon 136 is a unitary piece fabricated from an injection molded plastic. However, it is appreciated that an integrally formed escutcheon may be formed from other materials and according to other techniques while obtaining the benefits of the instant invention.

Thirteen ribs 212 depend from escutcheon lower edge 182, of which only five are representatively show in FIG. 4. Of the thirteen ribs 212, eleven span substantially an equal length of control panel mounting surface lower edge 190 and are approximately positioned equidistant from one another. Ribs 212 are generally arranged relative to one another to match the curvature of outer door panel 160 and to facilitate engagement of escutcheon 136 with outer door panel 160. That is, ribs 212 are located along a curved path that is complementary to curvature of outer door panel 160.

A pair of ribs 212 depend opposite one another adjacent escutcheon lateral edges 186, 188, respectively, and likewise are substantially equally spaced from adjacent ribs 212 located beneath control panel mounting surface 176. While the thirteen ribs 212 have been found adequate to satisfactorily position escutcheon 136 with respect to outer door panel 160 (shown in FIGS. 2 and 3), it is recognized that greater or fewer ribs 212 may be employed in alternative embodiments while achieving at least some of the benefits of the present invention. In addition, the thirteen ribs 212 have been found to generate a sufficient but not excessive interference fit with outer door panel 160 during assembly of the door, and it is recognized that altering the number of ribs 212 may positively or negatively affect an amount of force required to engage escutcheon 136 to outer panel 160, as well as the resultant interference fit for subsequent assembly operations requiring handling of door assembly 120 (shown in FIG. 2).

Figure 5:
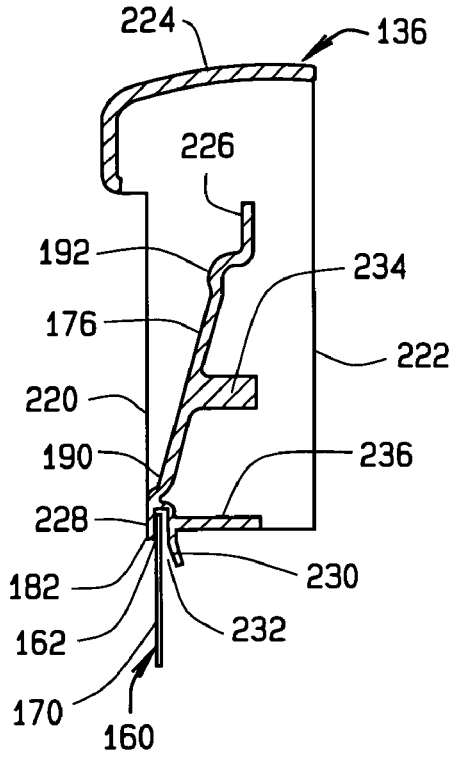
FIG. 5 is a cross sectional view of the escutcheon shown in FIG. 4 along line 5-5.

FIG. 5 is a cross sectional view of escutcheon 136 at a location between ribs 212. Control panel mounting surface 176 extends inwardly from control mounting surface lower edge 190, thereby forming a recessed surface for mounting of the control panel (not shown in FIG. 5) and associated components. Upper edge 192 of control mounting surface 176 is located between a front edge 220 and a rear edge 222 of escutcheon 136, and below an upper surface 224 of escutcheon 136. Escutcheon upper surface 224, in one embodiment, overhangs a front edge 220 of escutcheon 136. An escutcheon handle recess 226 extends upwardly from control panel mounting surface upper edge 192 and is substantially parallel to escutcheon front and rear edges 220, 222, respectively.

A lip 228 extends from control panel mounting surface 176 to escutcheon lower edge 182, and a lead-in flange 230 depends from control panel mounting surface lower edge 190 rearwardly and downwardly at a slight angle with respect to escutcheon lower edge 182 to form a retaining slot 232 between lead-in flange 230 and lip 228. A support bosses 234 and rib 236 extend rearwardly from control panel mounting surface 176 and from lead-in flange 230 for added rigidity of escutcheon 136. Upper edge 162 of outer door panel 160 is received within retaining slot 232 and panel outer surface 170 and escutcheon lower edge 182 are substantially flush with one another, at least partially due to ribs 212 (shown in FIG. 3).

Figure 6:
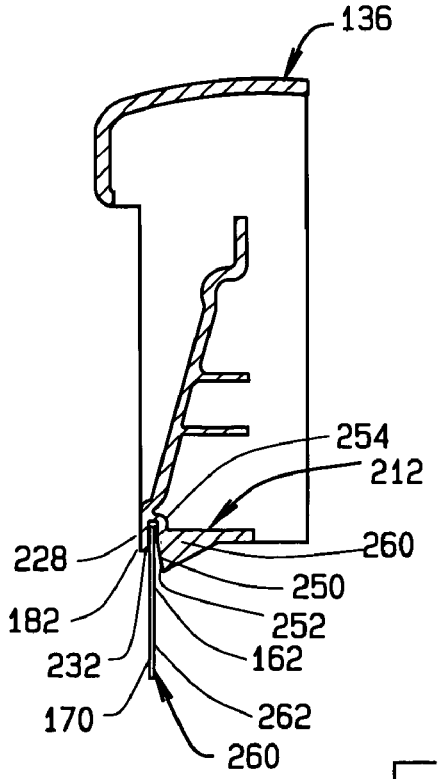
FIG. 6 is a cross sectional view of the escutcheon shown in FIG. 4 along line 6-6.

FIG. 6 is a cross sectional view of escutcheon 136 through one of ribs 212, and in which like reference components illustrated in FIG. 5 are indicated with like reference characters. Each of ribs 212 shown in FIG. 5 depending from escutcheon 136 are constructed similarly and are operationally functional as described below.

Rib 212 and escutcheon lip 228 define slot 232 for retaining upper edge 162 of enter door panel 160, and rib 212 includes an angled lower portion 250 forming a guide surface 252 to locate panel upper edge 162 within retaining slot 232, and a panel engagement portion 254 extending parallel to escutcheon lip 228 and defining slot 232 at an upper end of angled portion 250 of rib 212. Once panel upper edge 162 is located within retaining slot 232, rib panel engagement portion 254 engages upper panel edge 162 and, as necessary, flexes outer panel 160 so that it is generally flush with escutcheon lower edge 182. Rib 212 includes a reinforcing section 260 behind angled lower portion 250 to prevent flexing of rib 212 when engaging it to outer panel 160.

In the illustrated embodiment, escutcheon 136 may be attached to outer door panel upper edge 162 by rotating escutcheon 136 (clockwise in FIG. 6) and locating rib guide surface 252 adjacent an inner surface 262 of outer door panel 160. As such, escutcheon 136 may be pushed downwardly over outer panel 160 until panel upper edge 162 is located in retaining slot 232, and by rotating escutcheon 136 back toward outer surface 170 of outer door panel 160 (counterclockwise rotation in FIG. 6), rib panel engagement portion 254 of each rib 212 contacts panel upper edge 162 and positions panel upper edge 162 in a flush position with escutcheon lower edge 182. As this occurs simultaneously at a plurality of locations across escutcheon 136, i.e., at each location of ribs 212, upper edge 162 of outer door panel 160 is relatively easily engaged to escutcheon 136, and escutcheon 136 flexes or relocates portions of panel upper edge 162 as needed to create a desirable, flush appearance between escutcheon lower edge 182 and outer door panel upper edge 162.

In addition, angled guide surface 252 of ribs 212 account for some variation in curvature of outer door panels 162, and gradually guides panel upper edge 162 into place as escutcheon 136 is installed. Rib guide surface 252 therefore eliminates precise positioning of panel upper edge 162 within retaining slot 232, thereby avoiding difficult alignment of retaining slot 232 and panel upper edge 162 that can be particularly difficult when curvature of the retaining slot 232 and panel upper edge 162 are unequal due to manufacturing variances of the respective parts.

At least for the reasons above, it is believed that escutcheon 136 may be attached to outer door panel 160 in less time and with less expense than in conventional assemblies.

Figure 7:
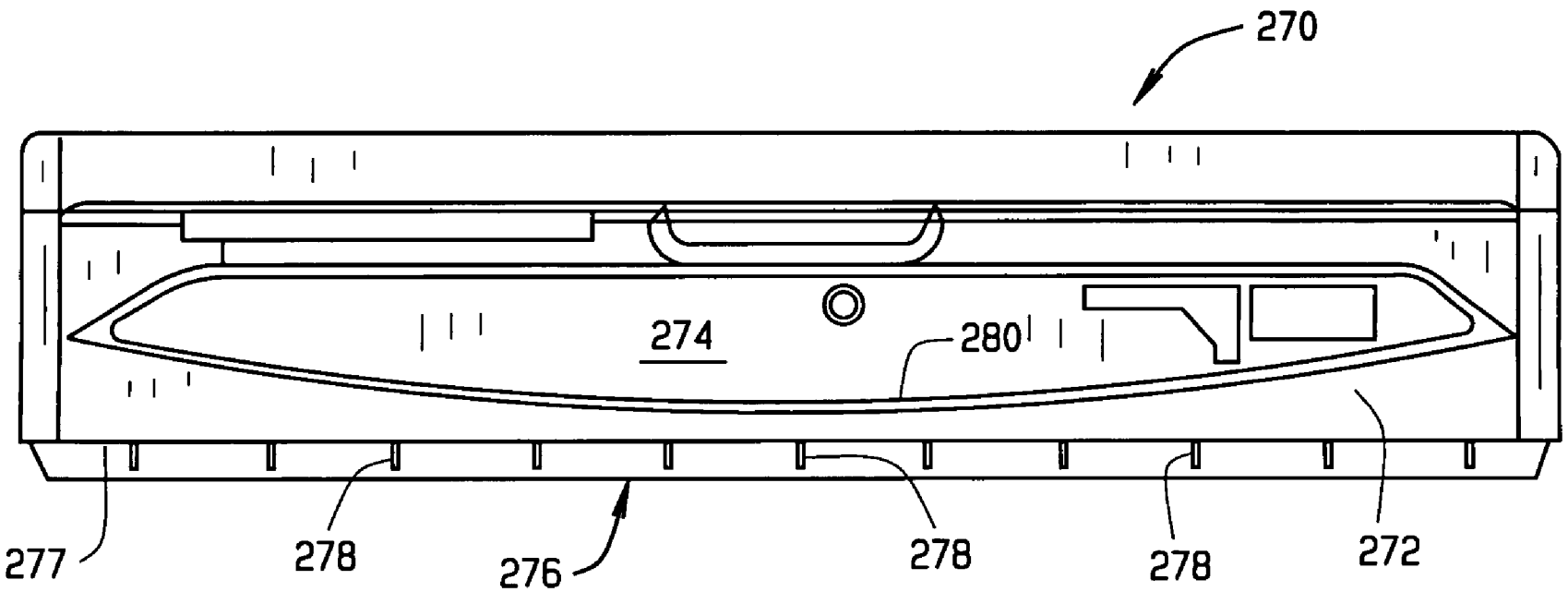
FIG. 7 is a front elevational view of a second embodiment of an escutcheon for the dishwasher door assembly shown in FIG. 2.

FIG. 7 is a front elevational view of a second embodiment of an escutcheon 270 for a dishwasher door assembly, such as door assembly 120 (shown in FIGS. 1 and 2). Unlike escutcheon 136 (shown in FIGS. 1-6), escutcheon 270 includes a curved lower front face 272 extending beneath a control panel mounting surface 274, and a plurality of formations 276 depending from a lower edge 277 of escutcheon 270 to facilitate proper positioning of escutcheon 270 relative to an outer door panel upper edge, such as edge 162 (shown in FIG. 2). Similar to those described above in relation to FIGS. 4-6, formations 276 define an elongated retaining slot (not shown in FIG. 7) for receiving an outer door panel upper edge 162, and a plurality of positioning ribs 278 extending into the slot to engage panel upper edge 162 and properly position outer panel 160 (shown in FIGS. 2 and 3) relative to the slot. As such, a uniform flush appearance between escutcheon lower edge 277 and outer panel upper edge 162 is consistently obtained while simplifying assembly of the door.

In one embodiment, escutcheon 270 is a unitary piece fabricated from an injection molded plastic. However, it is appreciated that an integrally formed escutcheon 270 may be formed from other materials and according to other techniques while obtaining the benefits of the instant invention.

Also, and further unlike escutcheon 136 (shown in FIGS. 1-6), eleven ribs 278 depend from escutcheon lower edge 277, span substantially an equal length of control panel mounting surface lower edge 280 and are approximately positioned equidistant from one another. Ribs 278 are generally arranged relative to one another to match the curvature of outer door panel 162 and to facilitate engagement of escutcheon 270 with outer door panel 160, and further to match the curvature of escutcheon lower front face 272. Thus, a flush appearance is achieved between a bowed outer door panel 160 and a bowed escutcheon lower front face 272.

While the eleven ribs 278 illustrated in FIG. 47 have been found adequate to satisfactorily position escutcheon 270 with respect to an outer door panel, such as outer door panel 160 (shown in FIGS. 2 and 3), it is recognized that greater of fewer ribs 278 may be employed in alternative embodiments while achieving at least some of the benefits of the present invention. In addition, the illustrated eleven ribs 278 have been found to generate a sufficient but net excessive interference fit with outer door panel 160 during assembly of the door, and it is recognized that altering the number of fibs 278 may positively or negatively affect an amount of force required to engage escutcheon 270 to panel 160, as well as the resultant interference fit to withstand handling of the door assembly in subsequent assembly operations.

Aside from the noted differences between escutcheon 270 and escutcheon 136, escutcheon 270 is structurally similar to and operationally functional as described above in relation to FIGS. 5 and 6.

While the invention has been described in terms of various specific embodiments, those skilled in the art will recognize that the invention can be practiced with modification within the spirit and scope of the claims.

The invention claimed is:

1. An escutcheon for an appliance door assembly, said escutcheon comprising:

a front edge and a rear edge horizontally spaced from said front edge, said front and rear edges vertically depending from an escutcheon upper surface;

a control panel mounting portion comprising a mounting surface and a lower edge, said control panel mounting portion extending upwardly and inwardly from said lower edge and between said front and rear edges, said control panel mounting portion including a plurality of openings therethrough;

a plurality of formations downwardly depending from said lower edge, said plurality of formations comprising:

a flange and a lip in combination defining a retaining slot configured to receive an appliance door panel such that said appliance door panel and said lower edge form a substantially flush surface; and a plurality of positioning ribs, each rib of said plurality of positioning ribs having a portion extending into said retaining slot configured to engage the appliance door panel and a reinforcing section extending from said flange and away from said retaining slot configured to prevent flexing of said plurality of positioning ribs.

2. An escutcheon in accordance with claim 1 wherein the appliance door panel comprises an outer panel with a curved outer surface, said plurality of positioning ribs arranged beneath said lower edge to approximately match the curvature of the outer panel.

3. An escutcheon in accordance with claim 1 wherein each of said plurality of positioning ribs further comprises a guide surface extending at an acute angle with respect to a said lip at least partially defining said slot.

4. An escutcheon in accordance with claim 3 wherein each of said plurality of positioning ribs further comprises a panel engagement portion extending from said guide surface defining said retaining slot.

5. An escutcheon in accordance with claim 1 further comprising a curved front face extending beneath said lower edge.

6. An escutcheon in accordance with claim 1 wherein said flange extends at an acute angle from said lip.

* * * * *